US009058786B2

(12) United States Patent
Keitaro et al.

(10) Patent No.: US 9,058,786 B2
(45) Date of Patent: Jun. 16, 2015

(54) ACTIVE MATRIX TYPE LIQUID CRYSTAL DISPLAY DEVICE AND RELATED DRIVING METHODS

(75) Inventors: Yamashita Keitaro, Hyogo (JP); Matsui Yoshikazu, Hyogo (JP)

(73) Assignee: INNOLUX CORPORATION, Miao-Li County (TW)

( * ) Notice: Subject to any disclaimer, the term of this patent is extended or adjusted under 35 U.S.C. 154(b) by 1281 days.

(21) Appl. No.: 12/904,266

(22) Filed: Oct. 14, 2010

(65) Prior Publication Data

US 2011/0084950 A1 Apr. 14, 2011

Related U.S. Application Data

(60) Provisional application No. 61/251,415, filed on Oct. 14, 2009.

(30) Foreign Application Priority Data

Oct. 6, 2010 (TW) ..... 99133989 A

(51) Int. Cl.
*G09G 3/36* (2006.01)

(52) U.S. Cl.
CPC ..... *G09G 3/3648* (2013.01); *G09G 3/3618* (2013.01); *G09G 2300/0809* (2013.01); *G09G 2300/0842* (2013.01); *G09G 2320/0247* (2013.01); *G09G 2330/021* (2013.01)

(58) Field of Classification Search
CPC ..... G09G 3/3648; G09G 3/3618; G09G 2300/0809; G09G 2300/0842; G09G 2320/0247; G09G 2330/021
USPC ..... 345/98, 99
See application file for complete search history.

(56) References Cited

U.S. PATENT DOCUMENTS

| | | | | |
|---|---|---|---|---|
| 5,945,972 | A * | 8/1999 | Okumura et al. | 345/98 |
| 6,897,843 | B2 | 5/2005 | Ayres | |
| 2002/0084463 | A1 | 7/2002 | Sanford | |
| 2004/0141396 | A1 * | 7/2004 | Ting et al. | 365/222 |
| 2007/0040785 | A1 | 2/2007 | Edwards | |
| 2008/0316848 | A1 * | 12/2008 | Ohsawa | 365/222 |
| 2010/0110067 | A1 | 5/2010 | Yamashita | |
| 2010/0177083 | A1 | 7/2010 | Yamashita | |

OTHER PUBLICATIONS 7.2: Measuring Color Breakup of Stationary Images in Field-Sequential-Color Displays; Toni Järvenpää; Nokia Research Center, Tampere, Finland, 2005.

* cited by examiner

*Primary Examiner* — Jonathan Boyd
(74) *Attorney, Agent, or Firm* — McClure, Qualey & Rodack, LLP

(57) ABSTRACT

An active matrix type liquid crystal display is disclosed. The liquid crystal display comprises a plurality of pixel elements arranged in the form of a matrix. Each of the pixel elements comprises a liquid crystal element and a dynamic memory. The dynamic memory performs consecutively, a first, a second, a third, a forth, a fifth, and a sixth refreshes for inversing a digital output status of the dynamic memory, and an interval between the first and the second refreshes is different from an interval between the third and the forth refreshes, and the interval between the third and the forth refreshes is different from an interval between the fifth and the sixth refreshes.

20 Claims, 7 Drawing Sheets

ACTIVE MATRIX TYPE LIQUID CRYSTAL DISPLAY DEVICE AND RELATED DRIVING METHODS

CROSS REFERENCE TO RELATED APPLICATIONS

This application claims the right of priority based on U.S. Provisional Application No. 61/251,415 entitled "LIQUID CRYSTAL DISPLAY DEVICE AND RELATED DRIVING METHODS", filed on Oct. 14, 2009 and Taiwan Patent Application No. 99133989 filed on Oct. 6, 2010, both of which are incorporated herein by reference.

FIELD OF INVENTION

The present invention relates to a liquid crystal display (LCD) and related driving method, particular to a LCD having "memory in pixel" and its related driving method.

BACKGROUND OF THE INVENTION

The MIP (Memory In Pixel) technology has been proposed for including a memory in each pixel, for providing the data written into the pixel while the active-matrix type display device is in the static image display mode. Thus, the data write-in process of the driver can thus be substituted, and the power-consumption can also be decreased, as described in U.S. Pat. No. 6,897,843 and US Pub. 2002/084463, which is incorporated herein by reference.

Generally, in the MIP technology, for maintaining the data stored in the memory of each pixel, a DRAM (Dynamic Random Access Memory) or a SRAM (Static Random Access Memory) could be used. The SRAM consists of a circuit, which has plural transistors arranged in sequence. The DRAM consists of a transistor and a capacitor. Thus, the DRAM is preferred in the respect of minimizing the covering area of the circuit and reducing the spacing between the pixels. However, for maintaining the small charge stored in the capacitor of the DRAM, a refreshing process has to be executed regularly. An example of the pixel circuit using the DRAM therein can be found in US Pub. 2007/040785, which is incorporated herein by reference.

Some more background of MIP technology are described in, for example, US Pub. 2010/177083 and US Pub. 2010/110067, which are incorporated herein by reference.

SUMMARY OF THE INVENTION

One aspect of the present invention is to provide an LCD that can have a gradual transition of transmittance/reflectance for the polarity inversion of the liquid crystal.

Another aspect of the present invention is to provide an LCD with a new manner for the refreshing of DRAM MIP.

Still another aspect of the present invention is to provide an LCD that can save power consumption and reduce the flicker visibility at the same time.

In one embodiment, disclosed is an active matrix type liquid crystal display including a plurality of pixel elements arranged in the form of a matrix. Each of the pixel elements comprises a liquid crystal element, a source line, a gate line, and a dynamic memory. Disposed at an intersection points of the source line and the gate line, the dynamic memory performs consecutively, a first, a second, a third, a forth, a fifth, and a sixth refreshes for inversing a digital output status of the dynamic memory. An interval between the first and the second refreshes is different from an interval between the third and the forth refreshes, and the interval between the third and the forth refreshes is different from an interval between the fifth and the sixth refreshes. Meanwhile, an embodiment also discloses an electronic device including the LCD as described above, a driver circuit for driving the dynamic memory, and a power supply connected to the LCD device to supply power to the LCD.

In another embodiment, disclosed is a method for driving a dynamic memory in a pixel of LCD. The method includes: adopting a driver circuit to send a driving signal to the dynamic memory; and in response to the driving signal, the dynamic memory performing a plurality of refreshes for inversing a digital output status of the dynamic memory. The transmittance/reflectance of the liquid crystal element is controlled by a digital output of the dynamic memory. Further, the plurality of refreshes include, consecutively, a first, a second, a third, a forth, a fifth, and a sixth refreshes, and an interval between the first and the second refreshes, an interval between the third and the forth refreshes, and an interval between the fifth and the sixth refreshes are increasing or decreasing in turn.

The foregoing and other features of the invention will be apparent from the following more particular description of embodiment of the invention.

BRIEF DESCRIPTION OF THE DRAWINGS

The present invention is illustrated by way of example and not intended to be limited by the figures of the accompanying drawing, in which like notations indicate similar elements.

DETAILED DESCRIPTION

Figure 1A:
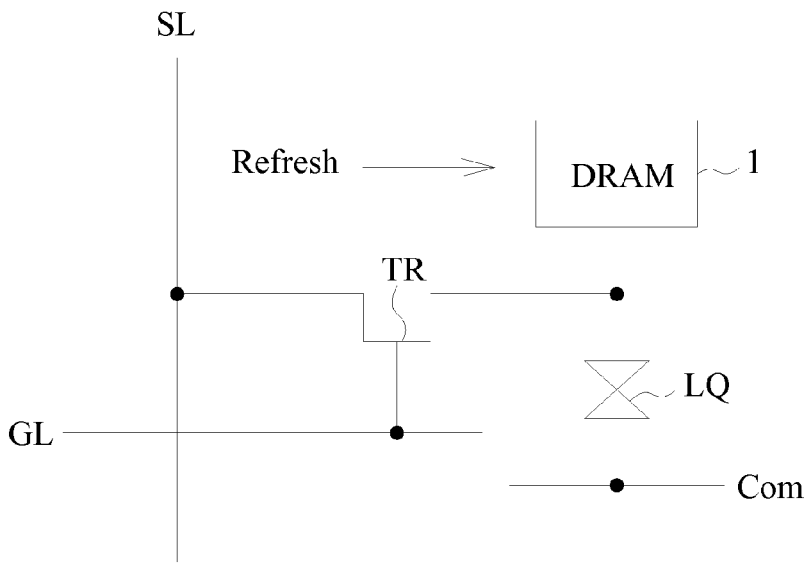
FIG.1A (Prior Art)
FIG. 1A shows a conventional DRAM MIP of a LCD.

FIG. 1A shows a conventional DRAM MIP of a LCD. A control transistor TR controlled by a gate line GL supplies the data from a source line SL to one end of a liquid crystal cell LQ, and the other end thereof is connected to a common electrode Com. A DRAM cell is connected to a connecting point between the control transistor TR and the liquid crystal cell LQ. The DRAM cell is configured to store the data supplied to the liquid crystal cell LQ. Therefore, when the image does not vary, the transmittance/reflectance of the liquid crystal cell using the stored data can be kept in the same status.

Figure 1B:
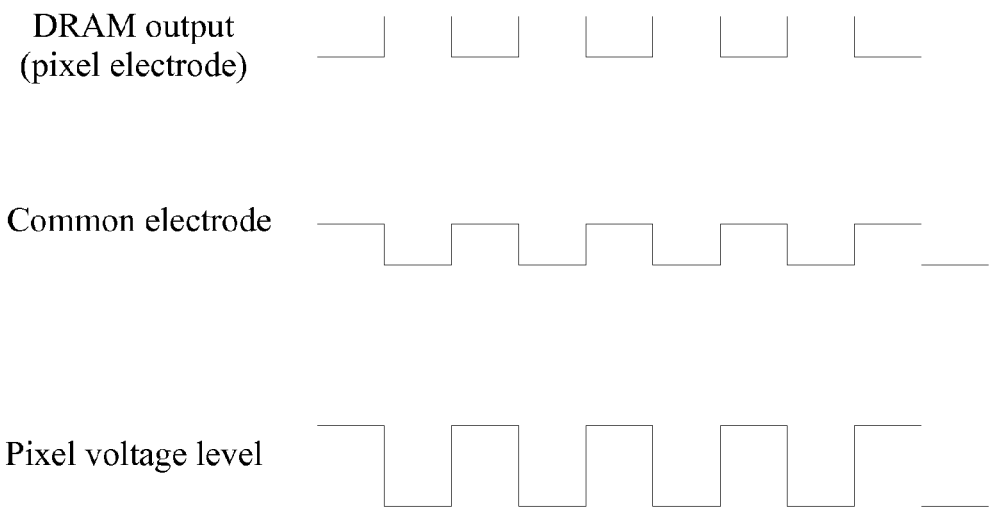
FIG.1B (Prior Art)
FIG. 1B shows the pixel voltage alternation and DRAM refresh in a conventional DRAM MIP.

DRAM MIP requires periodic refresh to maintain the stored memory, and the output signal polarity is flipped in every refreshing period. This output voltage is applied to the pixel electrode. Conventionally the interval of pixel voltage alternation and DRAM refresh period are the same. Also the pixel has a common electrode and the voltage on this is flipped in the same frequency as the pixel refreshing frequency. The pixel voltage polarity is flipped in every DRAM MIP refreshing interval, as shown in FIG. 1B.

Figure 1C:
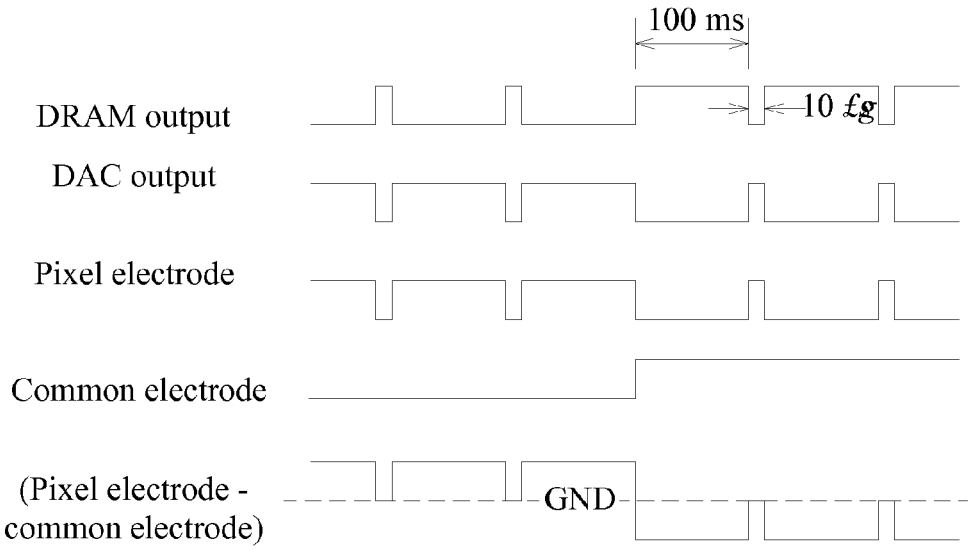
FIG.1C (Prior Art)
FIG. 1C shows the pixel voltage alternation and DRAM refresh in another conventional DRAM MIP.

Another conventional method for diving DRAM MIP is shown in FIG. 1C, where the DRAM has once refresh or twice refreshes in a short interval periodically, and the a refreshing frequency of the twice refreshing in the short interval is higher than an inversing frequency of the once refreshing which inverses the voltage polarity applied to the liquid crystal cells. As shown, the refreshing frequency of the DRAM corresponds to the maintenance of the memory content, and the refreshing required for the pixel, i.e., the polarity inversion, is used to prevent the image sticking effect. Therefore, the refreshing required for the pixel has not to be executed so frequently as the refreshing of the DRAM. The refreshing frequencies therefore the pixel and the DRAM need not to be identical.

Figure 2:
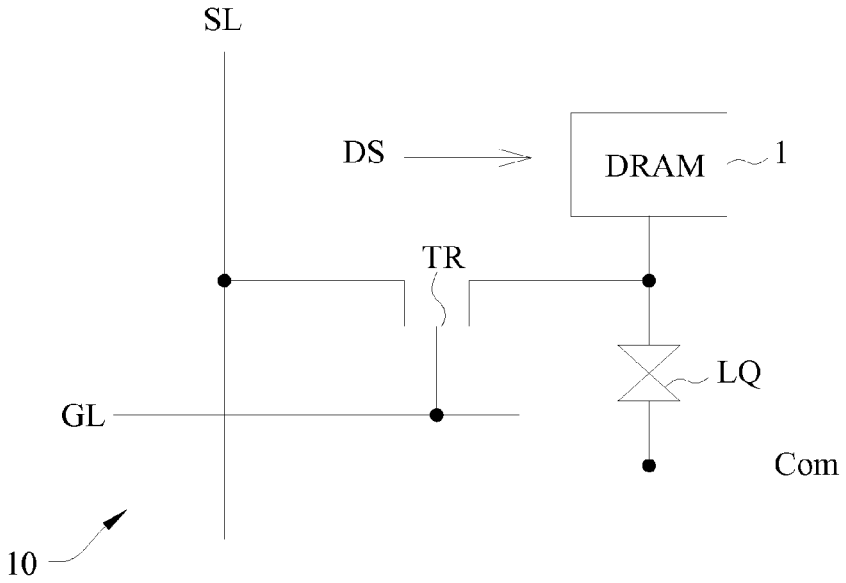
FIG. 2 is a block diagram showing a pixel structure of an active matrix type LCD according to one embodiment of the present invention.

FIG. 2 is a block diagram showing a pixel structure of an active matrix type LCD according to one embodiment of the present invention. The active matrix type LCD 10 comprises a plurality of pixel elements arranged in the form of a matrix, wherein the pixel elements comprise a plurality of liquid crystal elements LQ, at least one dynamic memory (DRAM) 1. Disposed at the intersection points of a plurality of source lines SL and a plurality of gate lines GL, the DRAM 1, in response to the driving signal DS from a driver circuit 2 (shown in FIG. 5), periodically performs refreshing for inversing the output status of the DRAM 1, wherein the transmittance/reflectance of each of the liquid crystal elements LQ is controlled by a digital output of the DRAM 1.

Referring back to FIG. 1C, the conventional driving manner adopts a single refresh to inverse the voltage polarity applied to the liquid crystal cell, to prevent the image sticking effect, while the quick twice refreshes before or after that single refresh have nothing to do with the voltage polarity. Because opposite polarity actually result in slight but still perceivable transmittance/reflectance change of the liquid crystal, this manner would result in sudden intensity change of light and would be easy to perceive by human eyes. By contrast, the DRAM 1 shown in FIG. 2 performs two or more refreshes in a short period for the polarity inversion to have a gradual transition of the transmittance/reflectance.

Figure 3:
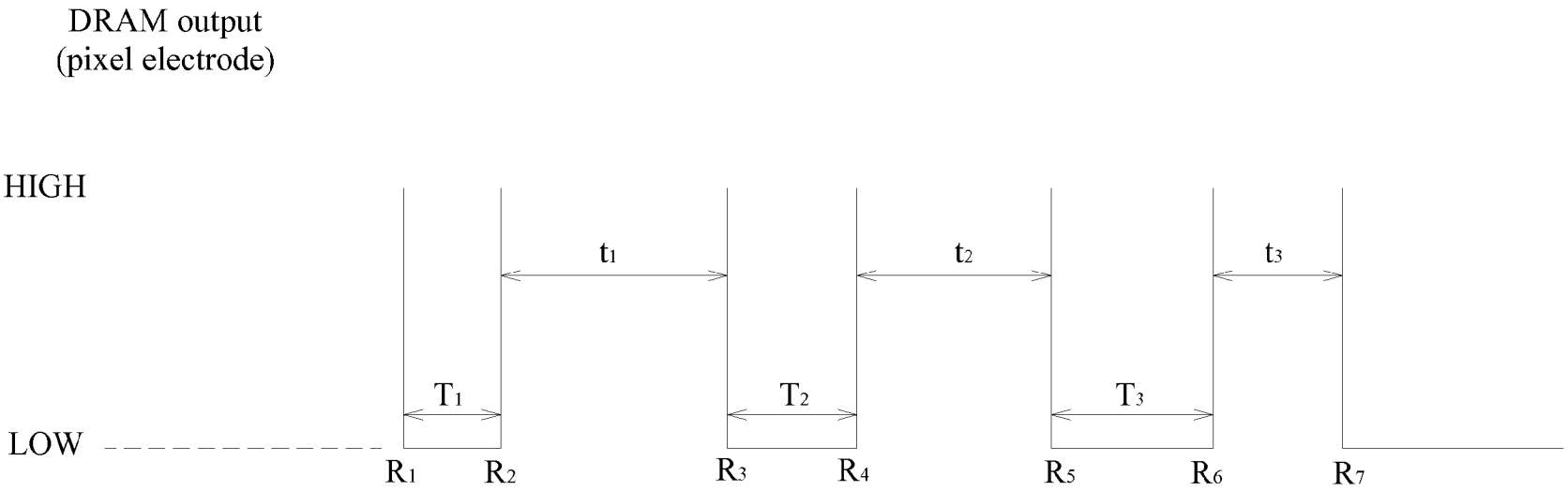
FIG. 3 exemplarily shows several refreshes for the polarity inversion according to one embodiment of the present invention.

Take FIG. 3 as an example. If the polarity inversion needs a voltage flip from a high level to a low level, instead of having only single refresh for a sudden inversion, the DRAM 1 provides a gradual inversion, by having some quick voltage flip (e.g., refreshes R1-R7) back and forth several times and, each time increasing the intervals (T1-T3) of the low level and decreasing the intervals (t1-t3) of the high level, until the polarity is completely inversed. Note that in the example in FIG. 3, the first two refreshes R1-R2 (and the interval T1) and the last two refresh R6-R7 (and the interval t3) may have no or little effect on polarity inversion, just as the twice refreshes in a short interval shown in FIG. 1C, but at least the middle three refreshes R3-R5 (and the intervals T2 and t2) will result in a more gradual polarity transition than the single refresh shown in FIG. 1C.

From the example above, it will always take DRAM 1 odd number of flips (refreshes) to achieve a complete polarity inversion. Also relevant to the present invention, the intervals of the low level (or the intervals of the high level) before the complete polarity inversion are defined by even number of flips (refreshes). In FIG. 3, to gradually have longer intervals of the low level as defined by 6 refreshes R1-R6, DRAM 1 has the interval T2 between the refreshes R3-R4 longer than the interval T1 between the refreshes R1-R2, and also have the interval T3 between the refreshes R5-R6 longer than the interval T2 between the refreshes R3-R4; on the other hand, to gradually have shorter intervals of the high level as defined by 6 refreshes R2-R7, DRAM 1 has the interval t2 between the refreshes R4-R5 shorter than the interval t1 between the refreshes R2-R3, and also have the interval t3 between the refreshes R6-R7 shorter than the interval t2 between the refreshes R4-R5.

The increasing of intervals T1-T3 is preferably, but not necessarily, corresponding to the decreasing of intervals t1-t3. Intervals t1-t3 could maintain as the same or are even increasing but should be slower than the increasing of intervals T1-T3.

The sum of intervals T1 and t1, the sum of intervals T2 and t2, the sum of intervals T3 and t3 could be the same or different or changing according to a predetermined manner. For example, the sum of intervals T2 and t2 could be longer or shorter than the sum of intervals T1 and t1 or the sum of intervals T3 and t2, while the sum of intervals T1 and t1 could be the same as or different from the sum of intervals T3 and t3.

Note that because of the viscosity of liquid crystal, the polarity cannot be completely inversed if the intervals of the low level accumulated in a given period of time are not longer enough, but the above driving manner is still useful for the DRAM refreshing. If this is a case, intervals T1-T3 are not necessarily increasing as long as the interval T1 is different from the interval T2, and the interval T2 is different from the interval T3. Similarly, intervals t1-t3 are not necessarily decreasing as long as the interval t1 is different from the interval t2 and the interval t2 is different from the interval t3. Intervals T1-T3 and intervals t1-t3 could be altered respectively in any specified manner to save power consumption, for example, or for any other practical purposes.

In the following three embodiments are provided to explain how to have several refreshes, instead of only single refresh, for a gradual polarity inversion. In each embodiment, for the exemplary purpose, DRAM 1 performs 55 refreshes with 27 intervals of the low level and 27 intervals of the high level, to complete the polarity inversion. Just as the example in FIG. 3, the first and the last several refreshes may have no or little effect on polarity inversion, just as the twice refreshes in a short interval shown in FIG. 1C.

These 55 refreshes will make the voltage level in a form of square wave with 27 pulses. Note that the invention does not like to limit the number of the refreshes for the polarity inversion as long as it takes more than one refresh. Also in practice the voltage of the square wave could be set at 5 volt and the frequency is around 60 Hz.

First Embodiment

Figure 4A:
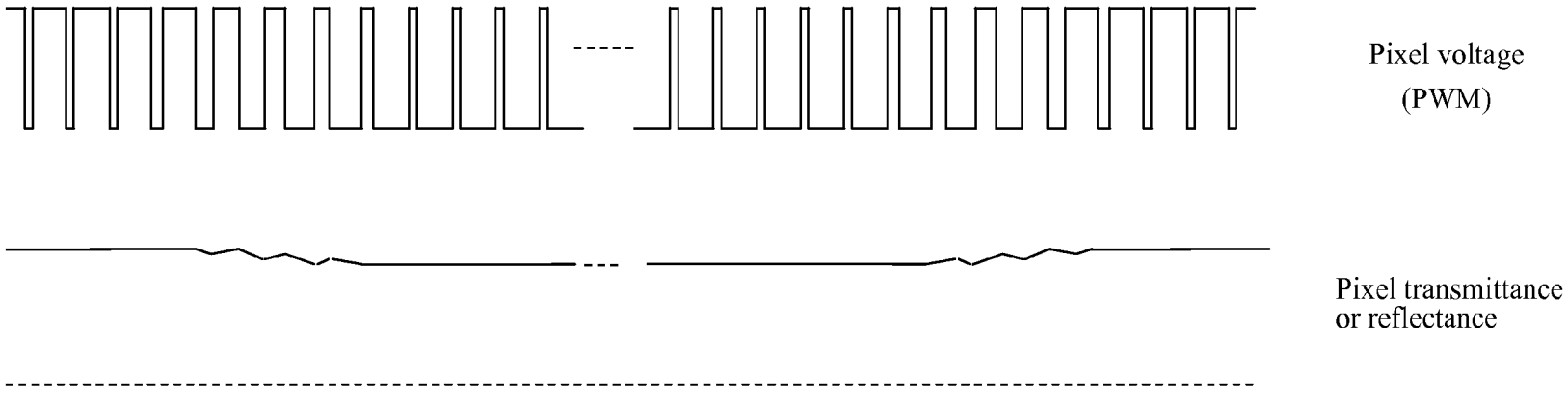
FIG. 4A shows a DRAM refreshing scheme with PWM according to one embodiment of the present invention.

In the first embodiment, the square wave will be modulated in pulse width modulation (PWM), which changes duty ratio gradually but maintains the frequency, as characterized below in Table 1. The square wave of a similar embodiment modulated in PWM is further illustrated in FIG. 4A. In this manner, there is no power increase compared with conventional standard burst MIP drive, because there is no change in carrier frequency. However very small visible optical transient may be still visible because human eye sensitivity is still high in such low frequency.

TABLE 1

| n | Period Low T (n) | Period High t (n) | Normalized freq. (a.u.) | Duty ratio of Low [%] |
|---|---|---|---|---|
| 1 | 1 | 19 | 1 | 5 |
| 2 | 1 | 19 | 1 | 5 |
| 3 | 1 | 19 | 1 | 5 |
| 4 | 1 | 19 | 1 | 5 |
| 5 | 1 | 19 | 1 | 5 |
| 6 | 2 | 18 | 1 | 10 |
| 7 | 3 | 17 | 1 | 15 |
| 8 | 4 | 16 | 1 | 20 |
| 9 | 5 | 15 | 1 | 25 |
| 10 | 6 | 14 | 1 | 30 |
| 11 | 7 | 13 | 1 | 35 |
| 12 | 8 | 12 | 1 | 40 |
| 13 | 9 | 11 | 1 | 45 |
| 14 | 10 | 10 | 1 | 50 |
| 15 | 11 | 9 | 1 | 55 |
| 16 | 12 | 8 | 1 | 60 |
| 17 | 13 | 7 | 1 | 65 |
| 18 | 14 | 6 | 1 | 70 |
| 19 | 15 | 5 | 1 | 75 |
| 20 | 16 | 4 | 1 | 80 |
| 21 | 17 | 3 | 1 | 85 |
| 22 | 18 | 2 | 1 | 90 |
| 23 | 19 | 1 | 1 | 95 |
| 24 | 19 | 1 | 1 | 95 |
| 25 | 19 | 1 | 1 | 95 |
| 26 | 19 | 1 | 1 | 95 |
| 27 | 19 | 1 | 1 | 95 |

Second Embodiment

Figure 4B:
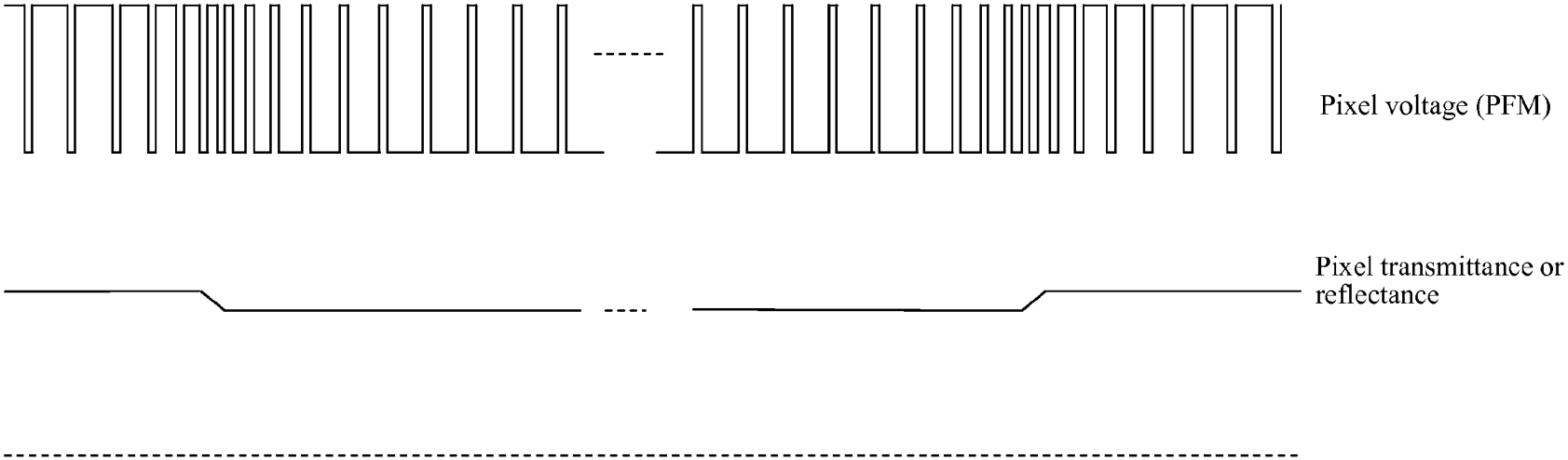
FIG. 4B shows a DRAM refreshing scheme with PFM according to one embodiment of the present invention.

In the second embodiment, the square wave will be modulated in pulse frequency modulation (PFM), which changes frequency gradually but maintains the duty ratio except a sudden change complementarily once, as characterized below in Table 2. The square wave of a similar embodiment modulated in PFM is illustrated in FIG. 4B. In this manner, power consumption is little increased because this driving has periodic high frequency drive. Furthermore very small visible optical transient could be still visible, because duty cycle is steeply changed at maximized frequency timing point.

TABLE 2

| n | Period Low T (n) | Period High t (n) | Normalized freq. (a.u.) | Duty ratio of Low |
|---|---|---|---|---|
| 1 | 1 | 19 | 1.0 | 5 |
| 2 | 1 | 19 | 1.0 | 5 |
| 3 | 1 | 19 | 1.0 | 5 |
| 4 | 1 | 19 | 1.0 | 5 |
| 5 | 1 | 19 | 1.0 | 5 |
| 6 | 0.9 | 17 | 1.1 | 5 |
| 7 | 0.8 | 15 | 1.3 | 5 |
| 8 | 0.7 | 13 | 1.4 | 5 |
| 9 | 0.6 | 11 | 1.7 | 5 |
| 10 | 0.5 | 9.5 | 2.0 | 5 |
| 11 | 0.4 | 7.6 | 2.5 | 5 |
| 12 | 0.3 | 5.7 | 3.3 | 5 |
| 13 | 0.2 | 3.8 | 5.0 | 5 |
| 14 | 0.1 | 1.9 | 10.0 | 5 |
| 15 | 1.9 | 0.1 | 10.0 | 95 |
| 16 | 3.8 | 0.2 | 5.0 | 95 |
| 17 | 5.7 | 0.3 | 3.3 | 95 |
| 18 | 7.6 | 0.4 | 2.5 | 95 |
| 19 | 9.5 | 0.5 | 2.0 | 95 |
| 20 | 11.4 | 0.6 | 1.7 | 95 |
| 21 | 13.3 | 0.7 | 1.4 | 95 |

TABLE 2-continued

| n | Period Low T (n) | Period High t (n) | Normalized freq. (a.u.) | Duty ratio of Low |
|---|---|---|---|---|
| 22 | 15.2 | 0.8 | 1.3 | 95 |
| 23 | 17.1 | 0.9 | 1.1 | 95 |
| 24 | 19 | 1 | 1.0 | 95 |
| 25 | 19 | 1 | 1.0 | 95 |
| 26 | 19 | 1 | 1.0 | 95 |
| 27 | 19 | 1 | 1.0 | 95 |

Third Embodiment

Figure 4C:
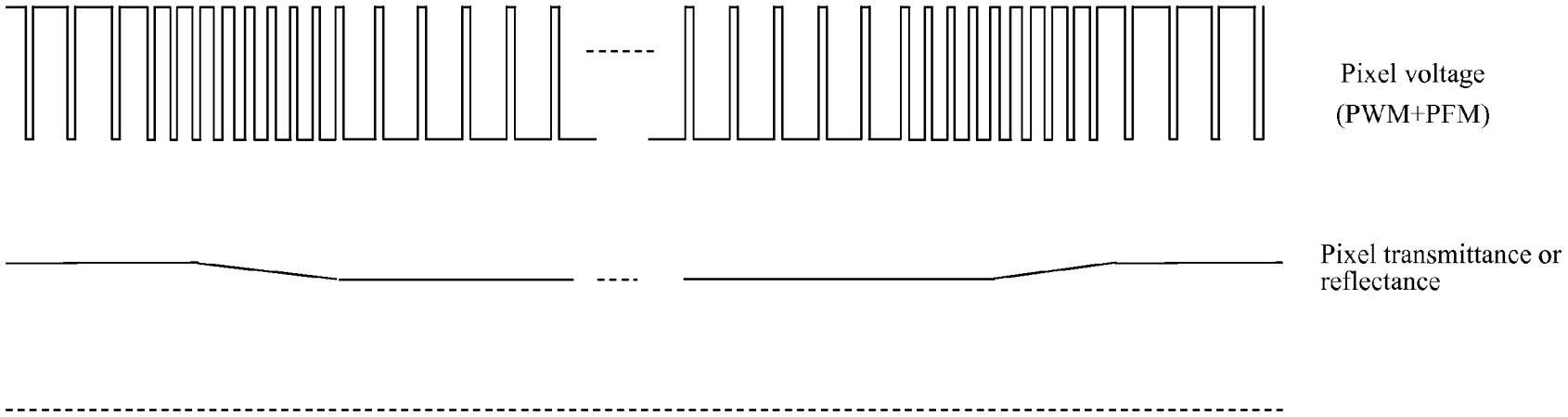
FIG. 4C shows a DRAM refreshing scheme with the combination of PWM and PFM according to one embodiment of the present invention.

In the third embodiment, the square wave will be modulated in combining PWM and PFM, which changes both the frequency and the duty ratio, as characterized below in Table 3. The square wave of a similar embodiment modulated in combining PWM and PFM is illustrated in FIG. 4C. In this manner, the human eyes detectability of optical change is smaller at high frequency with slow transient of flicker. This is the similar approach as field-sequential to show slow colour change with discrete colour patterns, as described in T. Järvenpää, "*Measuring color breakup of stationary images in field-sequential color displays*," SID 04 Digest, 7-2, which is incorporated herein by reference.

TABLE 3

| n | Period Low T (n) | Period High t (n) | Normalized freq. (a.u.) | Duty ratio of Low |
|---|---|---|---|---|
| 1 | 1 | 19 | 1.0 | 5.0 |
| 2 | 1 | 19 | 1.0 | 5.0 |
| 3 | 1 | 19 | 1.0 | 5.0 |
| 4 | 1 | 19 | 1.0 | 5.0 |
| 5 | 1 | 19 | 1.0 | 5.0 |
| 6 | 1 | 17 | 1.1 | 5.6 |
| 7 | 1 | 15 | 1.3 | 6.3 |
| 8 | 1 | 13 | 1.4 | 7.1 |
| 9 | 1 | 11 | 1.7 | 8.3 |
| 10 | 1 | 9 | 2.0 | 10.0 |
| 11 | 1 | 7 | 2.5 | 12.5 |
| 12 | 1 | 5 | 3.3 | 16.7 |
| 13 | 1 | 3 | 5.0 | 25.0 |
| 14 | 1 | 1 | 10.0 | 50.0 |
| 15 | 3 | 1 | 5.0 | 75.0 |
| 16 | 5 | 1 | 3.3 | 83.3 |
| 17 | 7 | 1 | 2.5 | 87.5 |
| 18 | 9 | 1 | 2.0 | 90.0 |
| 19 | 11 | 1 | 1.7 | 91.7 |
| 20 | 13 | 1 | 1.4 | 92.9 |
| 21 | 15 | 1 | 1.3 | 93.8 |
| 22 | 17 | 1 | 1.1 | 94.4 |
| 23 | 19 | 1 | 1.0 | 95.0 |
| 24 | 19 | 1 | 1.0 | 95.0 |
| 25 | 19 | 1 | 1.0 | 95.0 |
| 26 | 19 | 1 | 1.0 | 95.0 |
| 27 | 19 | 1 | 1.0 | 95.0 |

Figure 5:
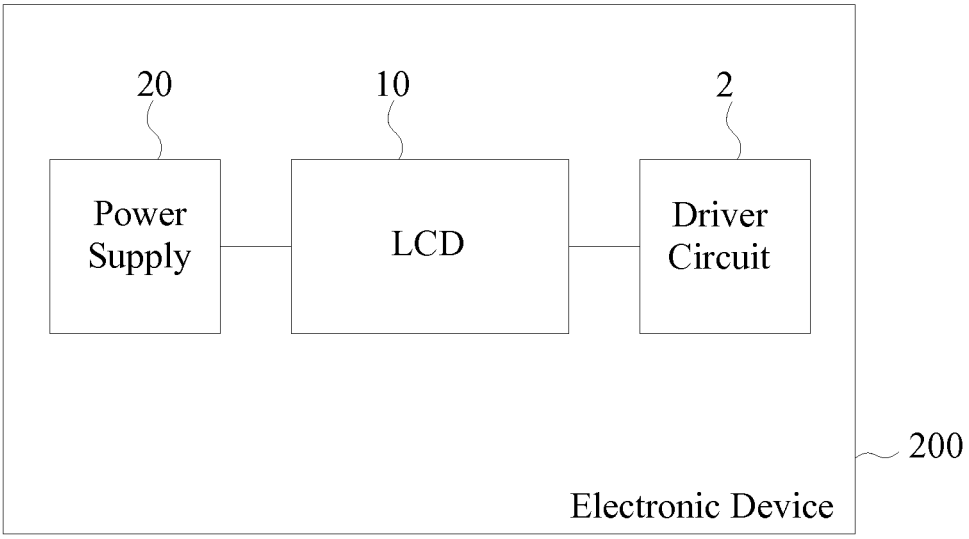
FIG. 5 is a diagram of an electronic apparatus according to an embodiment of the present invention.

FIG. 5 is a diagram of an electronic apparatus 200 according to an embodiment of the present invention. The electronic apparatus 200 has a driver circuit 2 and a power supply 20 connected to the LCD 10 to supply power to the LCD 10. The driver circuit 2 could be implemented as a semiconductor based logic circuit built in a source driver IC mounted on the side of LCD 10 or attached on a flexible print circuit board (FPC). In this embodiment, the LCD 10 is a color or monochromic image display integrated into the electronic apparatus 200.

Figure 6:
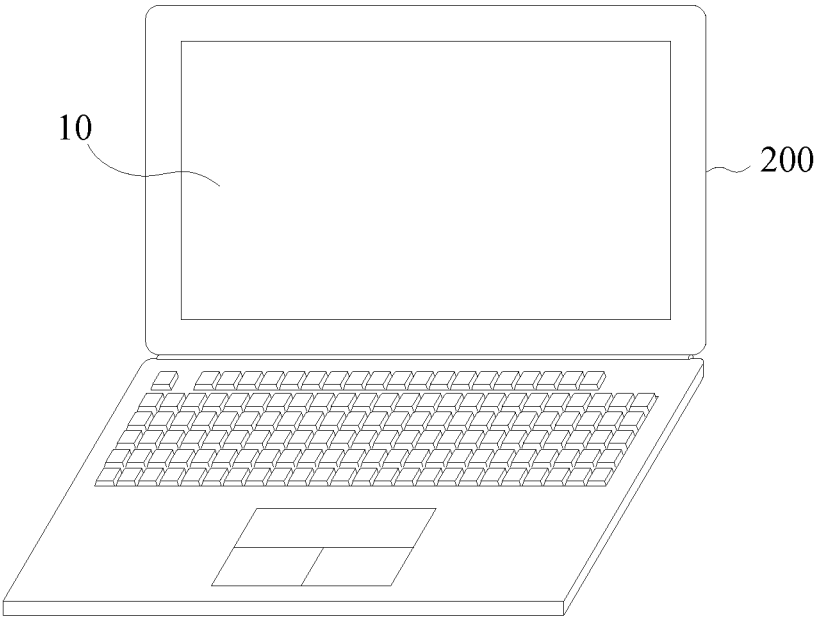
FIG. 6 illustrates an electronic apparatus according to an embodiment of the present invention.

Further shown in FIG. 6, the electronic apparatus 200 is shown as a laptop, the electronic apparatus 200 can alternatively be an electronic apparatus such as a mobile phone, a digital camera, a personal digital assistant (PDA), a notebook computer, a desktop computer, a television, a car media player, a portable video player, a GPS device, an avionics display or a digital photo frame.

The invention is applicable to various kinds of active matrix display devices and pixel circuits similar to those described above could be used in display devices other than AMLCD and AMLEDs where it is desirable to store a static image, for example in electrochromic, electrophoretic and electroluminescent type display devices. An example of an active matrix LED display device is described in EP-1116205 whose whole contents are incorporated herein as background material.

While this invention has been described with reference to the illustrative embodiments, these descriptions should not be construed in a limiting sense. Various modifications of the illustrative embodiment, as well as other embodiments of the invention, will be apparent upon reference to these descriptions. It is therefore contemplated that the appended claims will cover any such modifications or embodiments as falling within the true scope of the invention and its legal equivalents.

The invention claimed is:

1. An active matrix type liquid crystal display (LCD), comprising;

a plurality of pixel elements arranged in the form of a matrix, wherein each pixel element comprises:

a liquid crystal element;

a source line;

a gate line;

a dynamic memory disposed at an intersection points of said source line and said gate line to perform periodically a plurality of refreshes for inversing a digital output status of said dynamic memory and to have a gradual transition of transmittance/reflectance for the polarity inversion of the liquid crystal element;

wherein said plurality of refreshes comprise, consecutively, at least, a first, a second, a third, a fourth, a fifth, and a sixth refreshes;

wherein an interval between said first and said second refreshes is shorter than an interval between said third and said fourth refreshes, and said interval between said third and said fourth refreshes is shorter than an interval between said fifth and said sixth refreshes.

2. The LCD according to claim 1, wherein said dynamic memory performs more than one and odd number of refreshes to inverse the polarity of said liquid crystal element.

3. The LCD according to claim 1, wherein an interval between said first and said third refreshes is different from an interval between said third and said fifth refreshes.

4. The LCD according to claim 1, wherein an interval between said first and said third refreshes is the same as an interval between said third and said fifth refreshes.

5. The LCD according to claim 1, wherein a ratio of said interval between said first and said second refreshes to an interval between said first and said third refreshes is different from a ratio of said interval between said third and said fourth refreshes to an interval between said third and said fifth refreshes.

6. The LCD according to claim 1, wherein a ratio of said interval between said first and said second refreshes to an interval between said first and said third refreshes is the same as a ratio of said interval between said third and said fourth refreshes to an interval between said third and said fifth refreshes.

7. The LCD according to claim 1, wherein intervals among said first, said second, said third, said fourth, said fifth, and said sixth refreshes are modulated in pulse width modulation (PWM).

8. The LCD according to claim 1, wherein intervals among said first, said second, said third, said fourth, said fifth, and said sixth refreshes are modulated in pulse frequency modulation (PFM).

9. The LCD according to claim 1, wherein intervals among said first, said second, said third, said fourth, said fifth, and said sixth refreshes are modulated in combining PWM and PFM.

10. The LCD according to claim 1, wherein said interval between said first and said second refreshes, said interval between said third and said fourth refreshes, and said interval between said fifth and said sixth refreshes are increasing in turn.

11. A method to drive a dynamic memory in the LCD according to claim 1, comprising:

adopting a driver circuit to send a driving signal to said dynamic memory; and in response to said driving signal, said dynamic memory performing a plurality of refreshes for inversing a digital output status of said dynamic memory, wherein the transmittance/reflectance of said liquid crystal element is controlled by a digital output of said dynamic memory for polarity inversion;

wherein said plurality of refreshes comprise, consecutively, at least, a first, a second, a third, a fourth, a fifth, and a sixth refreshes;

wherein an interval between said first and said second refreshes, an interval between said third and said fourth refreshes, and an interval between said fifth and said sixth refreshes are increasing in turn.

12. The method according to claim 11, wherein said dynamic memory performs more than one and odd number of refreshes to inverse the polarity of said liquid crystal element.

13. The method according to claim 11, wherein an interval between said first and said third refreshes is different from an interval between said third and said fifth refreshes.

14. The method according to claim 11, wherein an interval between said first and said third refreshes is the same as an interval between said third and said fifth refreshes.

15. The method according to claim 11, wherein a ratio of said interval between said first and said second refreshes to an interval between said first and said third refreshes is different from a ratio of said interval between said third and said fourth refreshes to an interval between said third and said fifth refreshes.

16. The method according to claim 11, wherein a ratio of said interval between said first and said second refreshes to an interval between said first and said third refreshes is the same as a ratio of said interval between said third and said fourth refreshes to an interval between said third and said fifth refreshes.

17. The method according to claim 11, wherein intervals among said first, said second, said third, said fourth, said fifth, and said sixth refreshes are modulated in pulse width modulation (PWM).

18. The method according to claim 11, wherein intervals among said first, said second, said third, said fourth, said fifth, and said sixth refreshes are modulated in pulse frequency modulation (PFM).

19. The method according to claim 11, wherein intervals among said first, said second, said third, said fourth, said fifth, and said sixth refreshes are modulated in combining PWM and PFM.

20. An electronic device, comprising:

the LCD according to claim 1;

a driver circuit for driving said dynamic memory; and a power supply connected to the LCD to supply power to the LCD.

* * * * *